US006655862B1

(12) United States Patent
Johnson

(10) Patent No.: US 6,655,862 B1
(45) Date of Patent: Dec. 2, 2003

(54) METHOD FOR PRINTING ON TRANSPARENT SUBSTRATE IN ORDER TO OPTIMIZE LATER MARKABILITY

(75) Inventor: Steven M. Johnson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 10/202,081

(22) Filed: Jul. 22, 2002

(51) Int. Cl.[7] ..... B41J 3/62
(52) U.S. Cl. ..... 400/188; 400/18; 430/8
(58) Field of Search ..... 400/188, 18; 430/8

(56) References Cited

U.S. PATENT DOCUMENTS

| | | | | |
|---|---|---|---|---|
| 4,026,644 | A | | 5/1977 | Tsuchida et al. |
| 4,191,457 | A | | 3/1980 | Zingher |
| 4,332,872 | A | | 6/1982 | Zingher |
| 4,956,664 | A | | 9/1990 | Hasegawa et al. |
| 5,364,829 | A | | 11/1994 | Kishimoto et al. |
| 5,543,381 | A | | 8/1996 | Kishimoto et al. |
| 5,689,742 | A | * | 11/1997 | Chamberlain, IV ..... 396/313 |
| 5,707,543 | A | | 1/1998 | Akashi et al. |
| 6,022,111 | A | * | 2/2000 | Carls ..... 353/120 |
| 6,251,512 | B1 | | 6/2001 | Gustafson et al. |
| 6,291,551 | B1 | | 9/2001 | Kniess et al. |
| 6,326,120 | B1 | | 12/2001 | Wang et al. |
| 6,350,522 | B1 | | 2/2002 | Kyu-seok et al. |
| 6,468,637 | B1 | * | 10/2002 | Kwasny et al. ..... 428/201 |
| 2002/0182520 | A1 | * | 12/2002 | Torikoshi ..... 430/18 |
| 2003/0041183 | A1 | * | 2/2003 | LaPierre et al. ..... 710/1 |

* cited by examiner

*Primary Examiner*—Charles H. Nolan, Jr.
(74) *Attorney, Agent, or Firm*—James R. McDaniel

(57) ABSTRACT

This invention relates to the printing of transparent media often used for later projection, commonly referred to as Over Head Transparencies, or OHT's. These OHTs are used in several ways: They can be printed in advance and projected in sequence, created in the course of the presentation using marking pens, or a combination of he two, where a pre-printed OHT is edited or modified after printing or in the course of presentation using pens or other marking means. This third use is often compromised by incompatibilities between the marking technology used to create the pre-printed image and the marking pens used to edit the image later. This invention describes a technique for separating the two images, placing each on opposite sides of the transparent film, avoiding this conflict and producing a better solution for the user.

12 Claims, 2 Drawing Sheets

METHOD FOR PRINTING ON TRANSPARENT SUBSTRATE IN ORDER TO OPTIMIZE LATER MARKABILITY

FIELD OF THE INVENTION

This invention relates to the printing of transparent media often used for later projection, commonly referred to as Over Head Transparencies, or OHT's. These OHTs are used in several ways: They can be printed in advance and projected in sequence, created in the course of the presentation using marking pens, or a combination of he two, where a pre-printed OHT is edited or modified after printing or in the course of presentation using pens or other marking means. This third use is often compromised by incompatibilities between the marking technology used to create the pre-printed image and the marking pens used to edit the image later. This invention describes a technique for separating the two images, placing each on opposite sides of the transparent film, avoiding this conflict and producing a better solution for the user.

DESCRIPTION OF THE RELATED ART

Prior to the present invention, as set forth in general terms above and more specifically below, it is known, in the OHT art, to employ an OHT that can be marked upon. Exemplary of such prior art are the blank OHTs that presenters write/mark upon during their presentations. While these blank OHTs can be written/marked upon, they do not include a permanent, primary image. Consequently, if the presenter were to give the presentation several times, the presenter would have to continuously provide, at least, some of the same information on each blank OHT. Clearly, this repetitive writing/marking of the same material on the blank OHTs is time-consuming. Therefore, a more advantageous method, then, would be presented if the OHT that is to be repetitively used included a permanent, primary image that could be annotated.

It is also known, in the OHT art, to employ an inkjet printer or a LaserJet printer to print permanent, primary images on OHTs. While these systems have met with a modicum of success in printing permanent, primary images on OHTs, these systems have suffered from several deficiencies. First, the permanent, primary image is printed upon the side of the OHT facing away from the overhead projector so that the permanent, primary image can be correctly displayed by the overhead projector. This is the same surface that must then be marked by the presenter in making later modifications. Due to this location of the permanent, primary image on the OHT, the presenter encounters difficulties in annotating the permanent, primary image. For example, if an inkjet printer is used to print the permanent primary image, the presenter may smear/alter the permanent, primary image when the user marks/writes upon the permanent primary image. If a LaserJet printer is used to print the permanent, primary image, the presenter may not be able to properly annotate the permanent, primary image due to the waxy nature of the LaserJet printed permanent, primary image. Second, due to the fact that the permanent, primary image is printed upon the side of the OHT facing away from the overhead projector, the presenter may adversely affect the quality of the permanent, primary image when the presenter annotates the permanent, primary image. For example, the presenter may scratch the permanent, primary image with the writing/marking instrument when the presenter annotates the permanent, primary image. Finally, printer manufacturers suggest that the multipurpose (MP) tray of the printer be used to handle OHTs prior to printing upon the OHTs. This allows the OHTs to more easily and efficiently traverse through the printer without adversely affecting the print quality of the image on the OHT. While this method produces adequate image print quality on the OHTs, the OHTs are fed to the document handling section of the printer with the permanent, primary image facing up. Consequently, the user has to rearrange the printed OHTs so that the OHTs are in their correct order. Therefore, a still more advantageous method, then, would be presented if the permanent, primary image can be efficiently printed and easily annotated without adversely affecting the quality of the permanent, primary image.

It is further known, in the OHT art, to employ writable recording film. Exemplary of such prior art are U.S. Pat. No. 4,332,872 ('872) to A. R. Zingher, entitled "Optically Annotatable Recording Film" and U.S. Pat. No. 6,251,512 ('512) to F. J. Gustafson et al., entitled "Writable Matte Article." The '872 and '512 references employ methods that allow the user to write/mark upon a recording film, such as, an OHT. However, these references discuss the use of a specialized OHT that contains a permanent, primary image located on side of the OHT facing away from the overhead projector and a specialized layer facing towards the overhead projector. During the presentation, the presenter can use a variety of marking/writing techniques to change the chemical composition of the specialized layer in order to annotate the permanent primary image. Clearly, this adds expense to the preparation/printing of the OHT. Consequently, an even further advantageous method, then, would be presented if a conventional OHT could be utilized.

It is apparent from the above that there exists a need in the OHT art for a method for easily and efficiently printing permanent, primary images on the OHT such that the permanent, primary image can be easily annotated without adversely affecting the quality of the permanent, primary image, but which at the same time utilizes conventional, off-the-shelf OHTs. It is a purpose of this invention to fulfill this and other needs in the art in a manner more apparent to the skilled artisan once given the following disclosure.

SUMMARY OF THE INVENTION

Generally speaking, this invention fulfills these needs by providing a method for printing on an annotatable recording medium, wherein the method is comprised of the steps of: installing a recording medium having first and second sides located substantially across from each other in a medium printing device; formatting a desired primary image such that a mirror image of the primary image is printed on the first side of the recording medium; printing the mirror image on the recording medium; and annotating, if necessary, the primary image by marking the second side of the recording medium.

In certain preferred embodiments, the recording medium can be, but is not limited to, an overhead transparency (OHT). Also, the recording medium is, preferably, installed in the multipurpose (MP) tray of the medium printing device. Also, the medium printing device can be, but is not limited to, an inkjet printer, a LaserJet printer or the like. Finally, the primary image can be annotated through the use of marking pens or other such suitable marking/writing instruments.

In another further preferred embodiment, a mirror image of the primary, permanent image is easily and efficiently printed on the side of the OHT facing the overhead projector so that the primary, permanent image can be easily annotated on the other side of the OHT without adversely affecting the quality of the primary, permanent image.

The preferred OHT printing method, according to this invention, offers the following advantages: ease of printing; efficient printing of the primary, permanent image on the OHT; excellent protection of the permanent, primary image; excellent annotation of the permanent, primary image characteristics; use of conventional OHTs; excellent durability; and excellent economy. In fact, in many of the preferred embodiments, these factors of ease of printing, efficient printing, permanent, primary image protection, excellent annotation of the permanent, primary image characteristics, use of conventional OHTs, durability, and economy are optimized to an extent that is considerably higher than heretofore achieved in prior, known OHT printing methods.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
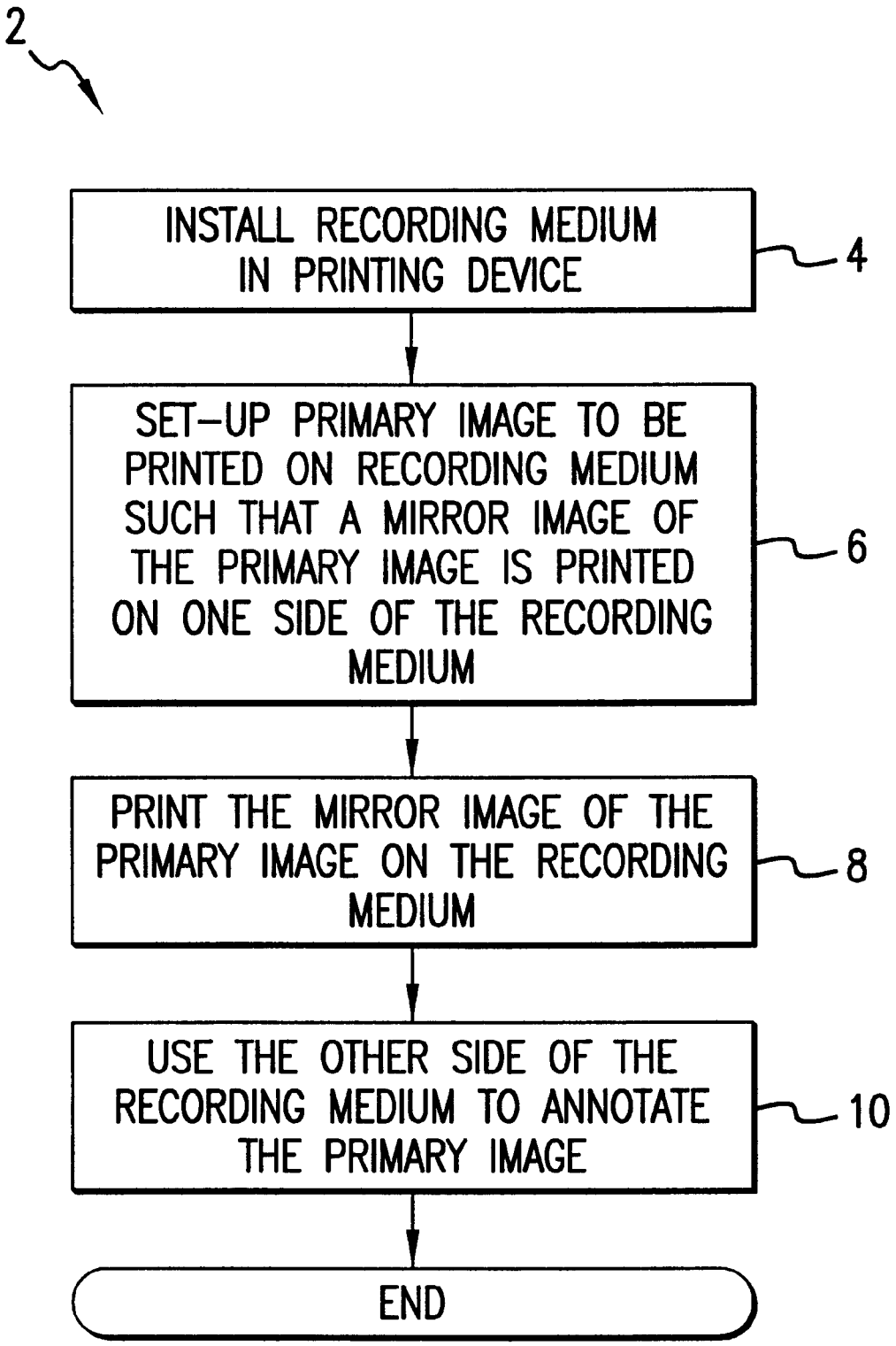
FIG. 1 is a flowchart that illustrates a method for printing on an annotatable recording medium, according to one embodiment of the present invention.

With reference first to FIG. 1, there is illustrated one preferred embodiment for use of the concepts of this invention. FIG. 1 is a flowchart that illustrates method 2 for printing on annotatable recording medium. Method 2, preferably, includes, in part, the steps of: installing a recording medium in a printing device (step 4); formatting the primary, permanent image to be printed on the recording medium such that a mirror image of the primary, permanent image is printed on one side of the recording medium (step 6); printing the mirror image of the primary, permanent mage on the recording medium (step 8); and using the other side of the recording medium to annotate the primary, permanent image (step 10).

With respect to step 4, the recording medium can be, but is not limited to, a conventional, off-the-shelf overhead transparency (OHT) or the like. Also, the printing device can be, but is not limited to, an inkjet printer, a LaserJet printer or any suitable printing device which is capable of printing upon an OHT or the like.

With respect to step 6, the primary, permanent image is formatted by the printing device print engine (not shown) or any other suitable device that is capable of formatting the primary, permanent image to produce a mirror image on the OHT. OHT printing has the nice feature that one can infer the use of the printout from its printing paper type. If a user selects paper type OHT, it can be inferred that this is a transparent media, and one can use a mirror image just as well as a standard one. From there, in a printer, an easy method of producing a mirror image can be utilized. Since printers are a raster device, the user can simply reverse the sequence of dots in each strip. This is simple and efficient.

With respect to step 8, the mirror image of the primary, permanent image is conventionally printed on the downward facing side of the OHT. This printing of a mirror image of the primary, permanent image on the downward facing side of the OHT results in a correct orientation of the primary, permanent image when the printed OHT is displayed by the overhead projector (not shown). It is to be understood that the printing device does not have to be mechanically altered/modified in order to print on the downwardly facing side of the OHT. As discussed above, conventional printers typically print on the upwardly facing side of an OHT.

After the OHT has been printed with the primary, permanent image, the printed OHT is conventionally transferred to the document handling section of the printing device such that the primary, permanent image faces upward towards the ceiling. In this manner, subsequent OHTs are printed with mirror images of the subsequent pages until the entire set is complete. Since each image is reversed and readable from the bottom facing side, once the entire stack is removed from the printer and turned over, the presentation is in correct order, eliminating the step of manually reversing each sheet to obtain correct ordering.

With respect to step 10, after the mirror image of the primary, permanent image has been printed on the downwardly facing side of the OHT, the presenter can use the upwardly facing side of the OHT to annotate the primary, permanent image. The primary, permanent image can be annotated by using marking pens or other such suitable marking/writing instruments. Due to the location of the primary, permanent image, any annotations placed upon the upwardly facing side of the printed OHT will not adversely affect the quality of the primary, permanent image or are not affected by that image.

Figure 2:
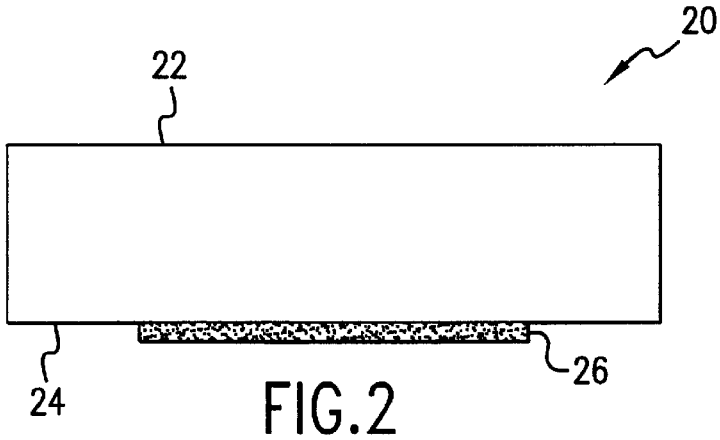
FIG. 2 is a schematic illustration of a side view of a conventional overhead transparency (OHT) after the OHT has been printed, according to one embodiment of the present invention.

FIG. 2 illustrates a schematic side view of an OHT 20, printed according to method 2 (FIG. 1). OHT 20, preferably, includes, in part, upwardly facing side 22, downwardly facing side 24, and primary, permanent image 26. Primary, permanent image 26 is, preferably, printed upon downwardly facing side 24, as described above with respect to FIG. 1.

Figure 3:
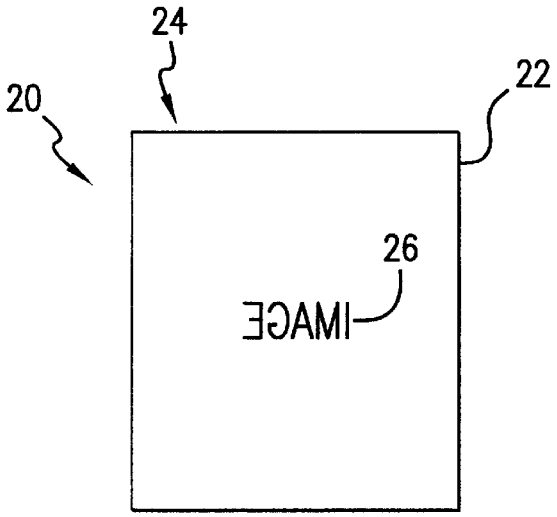
FIG. 3 is a schematic illustration of a front view of the OHT, as illustrated in FIG. 2, after the permanent, primary image has been printed.

FIG. 3 illustrates a front view of the printed OHT 20, as shown in FIG. 2. As can be seen in FIG. 3, a mirror image of primary, permanent image 26 has been printed upon the downwardly facing side 24 of OHT 20. As discussed above, this printed mirror image of primary, permanent image 26 on the downwardly facing side 24 of OHT 20 allows primary, permanent image 26 to be properly oriented when it is conventionally displayed by an overhead projector (not shown).

Figure 4:
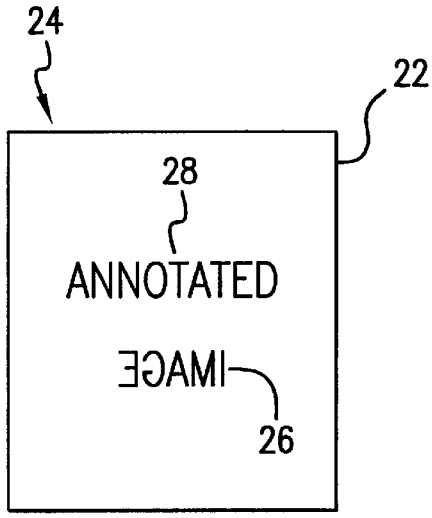
FIG. 4 is a schematic illustration of the front view of the OHT, as illustrated in FIG. 3, after the permanent, primary image has been annotated.

FIG. 4 illustrates the front view of the printed OHT 20, as shown in FIG. 3, with annotation 28 added to the upwardly facing side 22 of OHT 20. As can be seen in FIG. 4, the presenter has added annotation 28 through the use of conventional marking/writing instruments. Due to the fact that primary, permanent image 26 is located on the downwardly facing side 24 of OHT 20, the quality of primary, permanent image 26 cannot be adversely affected by the addition of annotation 28.

Once given the above disclosure, many other features, modifications or improvements will become apparent to skilled artisan. Such features, modifications or improvements are, therefore, considered to be a part of this invention, the scope of which is to be determined by the following claims.

What is claimed is:

1. A method for printing on an annotatable recording medium, comprising:

installing a recording medium having first and second sides located substantially across from each other in a medium printing device, such that said first side of said recording medium is a downwardly facing side and said second side of said recording medium is an upwardly facing side;

preparing a desired primary image such that a mirror image of said primary image is printed on said first side of said recording medium;

printing said mirror image on said recording medium; and annotating, said primary image by marking said second side of said recording medium.

2. The method, as in claim 1, wherein said recording medium is further comprised of:

an overhead transparency.

3. The method, as in claim 1, wherein said annotating step is further comprised of the step of:

using a marker on said second side of said recording medium.

4. The method, as in claim 1, wherein said annotating step is further comprised of the step of:

writing on said second side of said recording medium.

5. An apparatus for printing on an annotatable recording medium, comprising:

a means for installing a recording medium having first and second sides located substantially across from each other in a medium printing device, such that said first side of said recording medium is a downwardly facing side and said second side of said recording medium is an upwardly facing side;

a means for preparing a desired primary image such that a mirror image of said primary image is printed on said first side of said recording medium;

a means for printing said mirror image on said recording medium; and a means for annotating, said primary image by marking said second side of said recording medium.

6. The apparatus, as in claim 5, wherein said recording medium is further comprised of:

an overhead transparency.

7. The apparatus, as in claim 5, wherein said means for annotating is further comprised of:

a means for marking said second side of said recording medium.

8. The apparatus, as in claim 5, wherein said means for annotating is further comprised of:

a means for writing on said second side of said recording medium.

9. A printer for printing on an annotatable recording medium, comprising:

a means for installing a recording medium having first and second sides located substantially across from each other in a medium printing device, such that said first side of said recording medium is a downwardly facing side and said second side of said recording medium is an unwardly facing side;

a means for preparing a desired primary image such that a mirror image of said primary image is printed on said first side of said recording medium;

a means for printing said mirror image on said recording medium; and a means for annotating, said primary image by marking said second side of said recording medium.

10. The printer, as in claim 9, wherein said recording medium is further comprised of:

an overhead transparency.

11. The printer, as in claim 9, wherein said means for annotating is further comprised of:

a means for marking said second side of said recording medium.

12. The printer, as in claim 9, wherein said means for annotating is further comprised of:

a means for writing on said second side of said recording medium.

* * * * *

UNITED STATES PATENT AND TRADEMARK OFFICE

CERTIFICATE OF CORRECTION

PATENT NO. : 6,655,862 B1
DATED : December 2, 2003
INVENTOR(S) : Steven M. Johnson It is certified that error appears in the above-identified patent and that said Letters Patent is hereby corrected as shown below:

Column 1,
Line 13, delete “he” and insert therefor -- the --

Column 2,
Line 23, after “on” insert -- the --

Column 3,
Line 53, delete “mage” and insert therefor -- image --

Column 6,
Line 1, after “annotating” delete “,”
Line 23, delete “unwardly” and insert therefor -- upwardly --
Line 29, after “annotating” delete “,”

Signed and Sealed this

Eleventh Day of January, 2005

JON W. DUDAS
*Director of the United States Patent and Trademark Office*